United States Patent [19]

Tomii et al.

[11] Patent Number: 5,055,856

[45] Date of Patent: Oct. 8, 1991

[54] CAPPING DEVICE FOR INK JET PRINTERS

[75] Inventors: Tsuyoshi Tomii; Katsuhiko Iida, Nagano, both of Japan

[73] Assignee: Seiko Epson Corporation, Tokyo, Japan

[21] Appl. No.: 403,435

[22] Filed: Sep. 6, 1989

[30] Foreign Application Priority Data

| | | | |
|---|---|---|---|
| Sep. 7, 1988 | [JP] | Japan | 63-224078 |
| Nov. 2, 1988 | [JP] | Japan | 63-277909 |
| Nov. 5, 1988 | [JP] | Japan | 63-279676 |

[51] Int. Cl.[5] ..... B41J 2/165

[52] U.S. Cl. ..... 346/1.1; 346/140 R

[58] Field of Search ..... 346/140, 1.1

[56] References Cited

U.S. PATENT DOCUMENTS

| | | | |
|---|---|---|---|
| 4,429,320 | 1/1984 | Hattori | 346/140 |
| 4,684,963 | 8/1987 | Naka | 346/140 |
| 4,825,231 | 4/1989 | Nozaki | 346/140 |
| 4,829,318 | 5/1989 | Racicot | 346/140 X |

FOREIGN PATENT DOCUMENTS

| | | |
|---|---|---|
| 273855 | 11/1987 | Japan . |
| 279955 | 12/1987 | Japan . |
| 17056 | 1/1988 | Japan . |

*Primary Examiner*—Joseph W. Hartary

*Attorney, Agent, or Firm*—Blum Kaplan

[57] ABSTRACT

A capping device for an ink jet printer includes a cap supported on a cap support member adapted to press the cap against a print head with a uniform pressure distribution despite variation in the positional relationship between the print head and the cap support member. After the cap is sealed around an ink orifice of the printer, a preliminary suction operation reduces the pressure within a cavity defined by the cap and the print head. The pressure within the cavity is then returned to atmospheric pressure and then reduced again, but to a level which will not interfere with the ink meniscus level in the print head. The first period of suction lasts longer than the second suction period. By providing the capping device with tubes which resist the corrosive effects of ink and prevent gas from penetrating therethrough, excessive air buildup within the print head can be avoided.

19 Claims, 7 Drawing Sheets

CAPPING DEVICE FOR INK JET PRINTERS

BACKGROUND OF THE INVENTION

The invention relates generally to a capping device for an ink jet printer and more particularly to a device for securely and uniformly positioning a cap over an ink jetting orifice of an ink jet print head to seal the print head and then maintaining correct pressure and ink level within the print head.

A conventional ink jet printer typically includes a print head mounted on an electric machine which can be miniaturized. Ink is typically drawn to an appropriate level to ink jet nozzles by capillary action. When the print head is vibrated or tilted, such as when it is transported, ink typically flows backward from a front nozzle end of the print head to a level that is unsuitable for printing and can also spill out of the printer. In addition, ink at an ink jet nozzle can dry when the printer is not in use for a long period of time and interfere with printing. Both of these shortcomings of conventional printers adversely affect the ability of a printer to properly generate characters and images and undesirably increase printer down time.

To prevent ink from spilling from the printer or drying out, conventional printers have been fitted with capping devices. An example of a conventional capping device is described in Japanese Publication No. 15911/88 which describes a printer having a capping device designed to cover and seal the print head while the printer is not in use. The capping device includes a suction mechanism to draw the ink from an ink tank to a proper level in the print head so that the ink meniscus will be properly positioned at ink jet nozzles for printing.

This conventional capping device can often be effective in properly maintaining the meniscus level of ink when employed in conjunction with a print head in which ink in the ink tank is open to the air. If the tank is open to the air, the pressure in the tank is not reduced when ink is drawn from the reservoir and ink will not be siphoned back to the tank when the suction is released.

However, this capping device has been unsuitable for use in conjunction with an ink jet printer that includes a head damper, which has a diaphragm for absorbing pressure variation in ink caused by the back-and-forth movement of carriage, damper in an ink flow passage connecting an ink jet nozzle and an ink tank or another ink storage system in which the ink reservoir is not open to the atmosphere. As the suction device in the above conventional capping device draws the meniscus to a proper level at the ink jet nozzles, the pressure in the head damper becomes unacceptably low. Consequently, when the cap is removed to expose the ink jet nozzle to the atmosphere so that printing can occur, vacuum in the head damper siphons ink back into the head damper and lowers the meniscus to a level that is unacceptable for proper printing. Accordingly, this ink capping device does not adequately solve the problem of a lowered meniscus which can lead to imperfect ink discharge.

A conventional device for pressing a cap to a print head is described in Japanese Publication No. 15911/88 and is shown generally as capping device 110 in FIG. 11. Capping device 110 includes a cap support lever 53 pivotally mounted about a support lever fulcrum 53*a*. A first arm 53*b* of support lever 53 is pivotally mounted to a cap 52 at a cap fulcrum 52*a*. A second arm 53*c* of support lever 53 is rotatably coupled to a cam roller 56 in contact with a cam 55 having a caming surface 55'. Cap support lever 53 also includes a spring finger 53*d* coupled to a coiled tension spring 54. Tension from spring 54 constantly exerts a force to pivot cap support lever 53 clockwise and thereby urges cap 52 towards a closed sealed position against a print head 51. By selectively rotating cam 55, support member 53 can be selectively pivoted counterclockwise to displace cap 52 away from print head 51 to uncover an ink jet nozzles 51*a* to permit printing to occur.

Cap 52 is constructed and pivotally coupled to support lever 53 so that if print head 51 is unintentionally displaced longitudinally in the directions indicated by a double arrow A' with respect to cap 52, cap support lever 53 can pivot around fulcrum 53*a* in the directions indicated by a double arrow B' and cap 52 can pivot about fulcrum 52*a* in the directions indicated by double arrow C'. Accordingly, cap 52 will continue to be sealed against print head 51 during minor displacements of print head 51.

Cap 52 can only pivot in one direction with respect to print head 51. Thus, if print head 51 is displaced in a direction other than that of double arrow A', an improper non-uniform pressure distribution at a surface of cap 52 contacting print head 51 can occur. This can deform cap 52 and lead to an improper seal. The arrangement shown in FIG. 11 is only acceptable for certain types of ink jet printers. When cap 52 is sufficiently wide to cover a plurality of rows of nozzles included in a single print head, inadequate capping can occur more readily due to deformation of the cap from the uneven pressure distribution. An imperfect seal causes ink in the vicinity of the ink jet nozzles to dry which adversely affects ink discharge and can lead to ink leakage from the cap.

Another conventional ink jet printer capping device is described in Japanese Laid-Open Patent Application No. 260341/85. The capping device includes a cap having a thin tube disposed therethrough and an intermediate portion of the thin tube includes an expansible diaphragm-carrying chamber.

Still another conventional capping device is described in Japanese Patent Laid-Open No. 273855/87 which describes a device similar to an ink capping device shown as 101 in cross-section in FIG. 10. Capping device 101 includes a protective cap 42 for covering ink nozzles 41*a* of a print head 41. Before printing occurs, cap 42 is removed from the surface of print head 41 by a cap opening and closing device which is not shown in FIG. 10. A pair of tubes 47 and 49 are operatively coupled to cap 42 and are in fluid communication with cap interior 42*a* of cap 42 and with ink jet nozzles 41*a*. Tube 47 is coupled to and is in fluid communication with an expansible chamber 45 which includes a flexible diaphragm 45*a*. Expansible chamber 4 is operatively coupled to and is in fluid communication with another tube 48 which is coupled to a valve 46 for regulating the pressure within chamber 45 and thereby, within cap interior 42*a*. Tube 49 is coupled to the inlet of a suction pump 44 for reducing the pressure within cap interior 42*a*. Flexible tubes 47, 48 and 49 are formed of materials which are highly resistant to the corrosive effects of conventional inks.

When the meniscus of ink in print head 41 falls below an acceptable level, suction pump 44 applies suction to tube 49 and thereby to the ink passageways of print head 41 through nozzles 41*a* to draw the meniscus in print head 4! back to a suitable level. A valve 46 is provided to relieve unacceptable pressure levels that can develop within chamber 45.

Expandable chamber 45 is included in capping device 101 to absorb environmental pressure changes. Accordingly, atmospheric pressure changes will not generally adversely affect the volume of air in communication with interior 42*a* so that ordinary atmospheric pressure changes will not unacceptably displace the meniscus of ink within print head 41.

The ink located within print head 41, nozzles 41*a* and flexible tubes 47, 48 and 49 contains water. When the ink jet printer is exposed to high temperatures for an extended period of time, water in the ink will evaporate into water vapor and the volume and partial pressure of the water vapor in tubes 47, 48 and 49 will increase. Initially, expansible chamber 45 will expand and absorb this volume increase. However, as the partial pressure of water vapor increases the partial pressure of air molecules within capping device 101 decreases and becomes less than the partial pressure of the outside atmosphere. Tubes 47, 48 and 49 of a conventional capping device are typically formed of materials such as polyethylene or polytetrafluoroethylene or other materials which have a high resistance to the corrosive effects of ink, but allow air molecules to pass through relatively easily. As the partial pressure of air molecules within the tubes decreases, air will pass through the walls of tubes 47, 48 and 49 and cause the volume of gas therein to increase.

Eventually, the volume increase of gas cannot be absorbed by expansible chamber 45 and the internal pressure within capping device 101 will unavoidably begin to increase. At an ambient temperature of 40° C., the internal pressure can increase up to about 55.3 mmHg, the saturated vapor pressure at 40° C. This internal pressure within capping device 101 will overcome forces supporting the meniscus of ink at the front end portion of ink jet nozzles 41*a* and cause the meniscus to displace backwards to an unacceptable level. This leads to imperfect ink discharge and increases printer down time.

Accordingly, it is desirable to provide a capping device for an ink jet printer which will overcome these shortcomings of the prior art capping devices.

SUMMARY OF THE INVENTION

Generally speaking, in accordance with the invention, an ink capping device for a ink jet printer is provided. The ink capping device includes a cap for sealing the ink outlet portion of an ink jet print head, a suction device for maintaining a proper ink level within the print head and a valve to regulate pressure within the print head. The cap can be supported by and urged towards the print head by a support member to compensate for displacement of the print head with respect to the support member and maintain uniform pressure distribution at a contact surface between the cap and the print head. By applying successive suction operations to the cap, in which the second suction operation is shorter than the first, the ink meniscus level is maintained at a proper level for printing despite extended exposure of the print head to high temperatures.

Accordingly it is an object of the invention to provide an improved capping device for ink jet printers.

Another object of the invention is to provide a capping device for an ink jet printer that is capable of maintaining acceptable pressure within the cap and printer to prevent improper backward displacement of the ink meniscus at the ink jet nozzles.

A further object of the invention is to provide a mechanism for placing a cap of capping device for an ink jet printer against an ink jet print head with a secure and evenly pressured seal.

Another object of the invention is to provide a capping device for an ink jet print head which will maintain proper pressure within the print head during extended exposure to high temperatures.

Still other objects and advantages of the invention will in part be obvious and will in part be apparent from the specification and drawings.

The invention accordingly comprises the several steps and the relation of one or more of such steps with respect to each of the others, and the apparatus embodying features of construction, combinations of elements and arrangements of parts which are adapted to effect such steps, all as exemplified in the following detailed disclosure, and the scope of the invention will be indicated in the claims.

BRIEF DESCRIPTION OF THE DRAWINGS

For a fuller understanding of the invention, references is had to the following description taken in connection with the accompanying drawings, in which.

DESCRIPTION OF THE PREFERRED EMBODIMENTS

Figure 1:
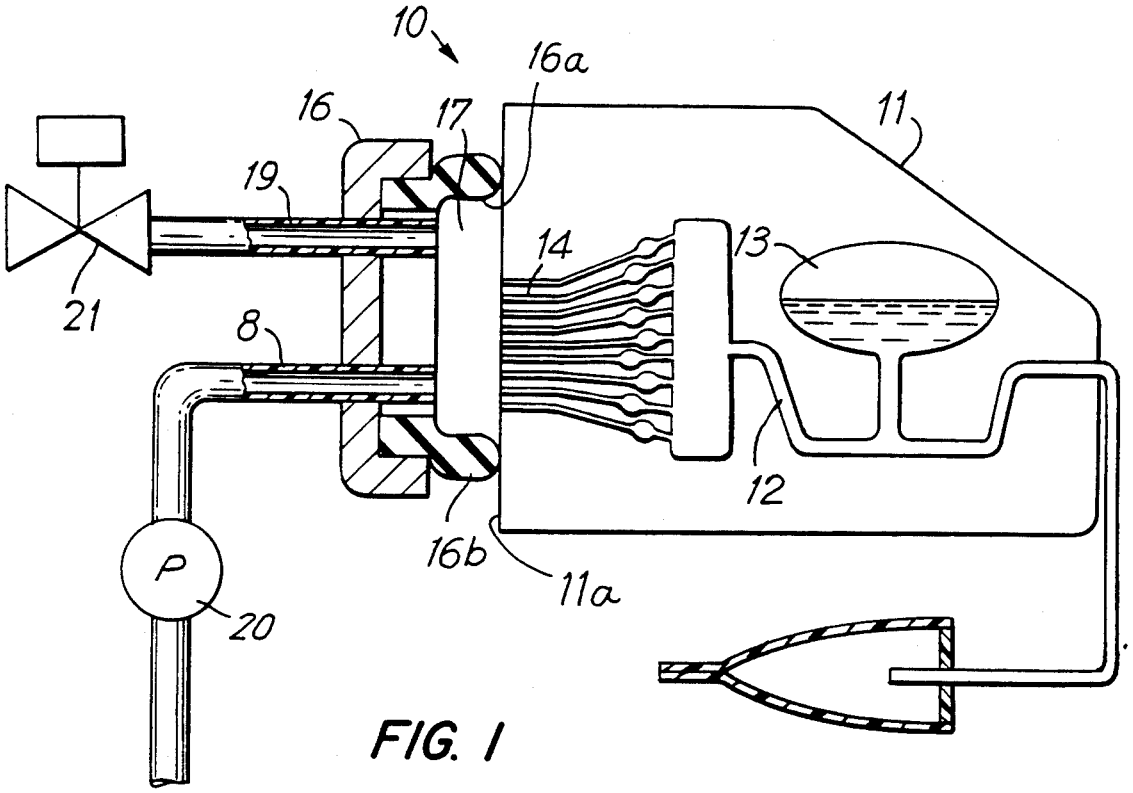
FIG. 1 is a partial sectional view of a print head capping device constructed and arranged in accordance with the invention.

A capping device 10 formed in accordance with the invention is shown in partial sectional view in FIG. 1. Capping device 10 is well suited for use with an ink on-demand ink jet printer including a print head 11. Print head !1 is typically fixed to a carriage that is not shown and is opposed to a recording medium shown) transferring ink thereto.

Print head 11 includes a head ink damper 13 which has a diaphragm for absorbing pressure variation in ink caused by the back-and-forth movement of a carriage. Damper 13 is in fluid communication with the atmosphere only at the front ink jetting surface 11*a* of print head 11 via an ink flow passage 12 coupled to an ink jet nozzle 14. Ink jet nozzle 14 is in fluid communication with an ink pack or ink reservoir (not shown) and is open to the atmosphere at front surface 11*a* of print head 11.

Capping device 10 includes an ink cap 16 having a deformable surface 16*b* fixed to an actuator (not shown) provided on the "home position" side of the carriage. Cap 16 is constructed to cover and form an air tight seal with front surface 11*a* of print head 11 around nozzles 14 during non-printing periods. Cap 16 has an inner surface 16*a* defining a cavity 17 in fluid communication with nozzles 14. A pair of thin tubes 18 and 19 protrude through cap 16 and are in fluid communication with cavity 17. Tube 19 is operatively coupled too a valve 21 and tube 18 is operatively coupled to a suction pump 20. Accordingly, suction pump 20 and valve 11 are in fluid communication with cavity 17 and head ink reservoir 13.

Figure 2:
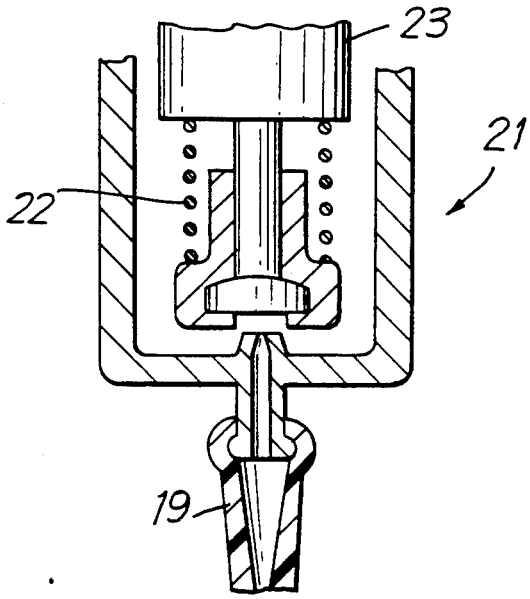
FIG. 2 is a cross-sectional view of a valve suitable for use in the capping device shown in FIG. 1.

An example of valve 21 particularly well suited for inclusion in capping device 10 is shown in cross-section in FIG. 2 Valve 21 includes a spring 22 to maintain valve 21 in a normally closed position and a solenoid 23. When solenoid 23 is energized, valve 21 is placed in ann open condition which places tube 19 and cavity 17 in fluid communication with the atmosphere at selected intervals selectively corresponding to operation of suction pump 20.

Figure 3:
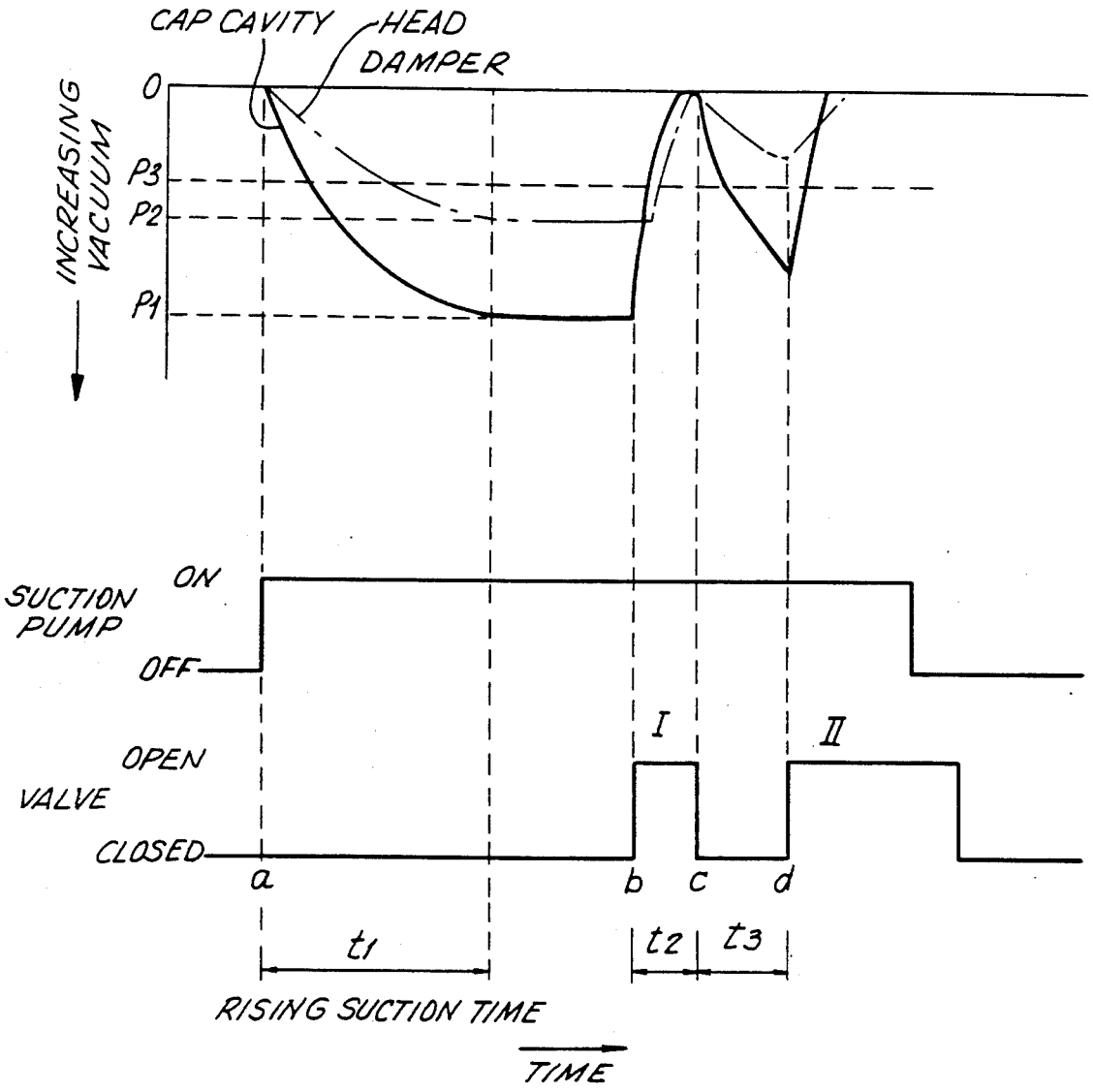
FIG. 3 is a graph showing changes in pressure in the cap cavity and interior of a print head ink reservoir and a timing diagram showing change in pressure in a capping device as a suction pump is turned on and off and as a valve is opened and closed.

Capping device 10 is constructed and arranged to maintain cavity 17 at an acceptable pressure and to maintain the ink meniscus at a proper level for printing. The pressure within cavity 17 and the position of the meniscus of ink is maintained by selected openings and closings of valve 21 and operation of suction pump 20. A first opening and closing operation is denoted preliminary opening and closing operation and a subsequent opening and closing operation is denoted primary opening and closing operation II. FIG. 3 is a timing diagram which illustrates the decrease in pressure (increase in vacuum) of cavity 17 (the solid line) and of head damper 13 (the broken line) as valve 21 is opened and closed while suction pump 20 is turned on and off.

Referring to FIG. 3, at a time a, valve 21 is closed and suction pump 20 begins applying suction to cavity 17 and thereby head damper 13. When valve 21 is closed for a time period $t_1$ (rising suction time) suction pump 20 decreases the pressure in cavity 17 to $P_1$ and decreases pressure in head damper 13 to $P_2$, a smaller degree of vacuum than $P_1$. After rising suction time $t_1$, suction pump 20 continues to operate, but the level of vacuum in cavity 17 and head reservoir 13 is at a maximum and does not increase significantly.

At time b, after maximum vacuum is reached, valve 21 is opened and remains open for a period of $t_2$ and then closes at time c. Time period $t_2$ corresponds to preliminary opening and closing operation I. Time $t_2$ is the minimum time necessary for pressure in cavity 17 and head damper 13 to increase to approximately atmospheric pressure from the reduced pressure conditions of $P_1$ and $P_2$.

From time to time suction pump 20 continues to operate while valve 21 is closed for a period of $t_3$. During interval $t_3$, which is shorter than rising suction time $t_1$, the vacuum in cavity 17 decreases, but $t_3$ is too short for the vacuum to reach a maximum, which is only reached after an interval lasting as long as $t_1$. Given that the meniscus of ink in print head 11 will not be siphoned below an acceptable level at a pressure in head reservoir 13 above $P_3$, interval $t_3$ is selected to be short enough so that the pressure in head damper 13 does not reach pressure $P_3$. At time d, the primary opening and closing operation II begins. Valve 21 T is opened and the pressure in head damper 13 and cavity 17 begins to rise. Suction pump 20 is turned off and thereafter, valve 21 is closed.

During the time that printing does not occur, cap 16 is disposed against print head 11 and seals nozzles 14. This will prevent ink at the front end portion of nozzles 14 from drying and solidifying. When the pressure in cavity 17 increases due to water evaporation, which would tend to displace the meniscus of ink at the front end portion of nozzle 14 backward and interfere with ink discharge, suction pump 20 begins to draw from cavity 17. This corresponds to time a of FIG. 3. As shown in FIG. 3 the pressure in cavity 17 gradually decreases to a maximum vacuum $P_1$ after rising suction time $t_1$ elapses. Period $t_1$ will typically last about 3–5 seconds, but depends on the construction of device 10, print head 11 and the resistance in tubes 18 and 19.

As pressure in cavity 17 decreases, ink is drawn to the front end of nozzle 14 and the pressure in head damper 13 is reduced to a pressure of $P_2$. $P_2$ will tend to be about 400 mmHg, for example. This low pressure will tend to destroy the meniscus of ink at nozzle 14 and will place print head II in a non-printing condition.

At time b, ink is at the very front end of nozzle 14. After about 9 seconds have elapsed, valve 21 is opened and outside air begins to flow into tube 19. The pressure in cavity 17 rises to about atmospheric pressure after a brief period elapses. As air flows into cavity 17 and the pressure in cavity 17 increases, ink which has reached the front end of nozzle 14 as a result of suction during period $t_1$ is drawn inward again because of low pressure $P_2$ in head reservoir 3. $P_2$ is low enough to destroy the meniscus of ink at nozzle 14.

After a short interval $t_2$, about 0.2 seconds, valve 21 is closed. The vacuum in cavity 17 again rises during period $t_3$ and ink returns to the front end of nozzle 14. Consequently, the pressure in head damper 13 also begins to decrease. At time d, after a period of $t_3$ elapses, valve 21 is opened, suction pump 20 is turned off and then valve 21 is closed. Period $t_3$ is shorter than $t_1$ and is not long enough for the pressure in head damper 13 to decrease to a value low enough to destroy the ink meniscus (below $P_3$). This last opening and closing corresponds to primary opening and closing operation II which may be repeated.

After primary opening and closing operation II is completed, ink is at and will remain at the ink jet nozzles at a proper position for printing. As a result of the sequence of openings and closings described above, the vacuum in head damper 13 is not high enough to siphon the ink at the nozzles to an improper position. Further, the pressure in cavity 17 is not high enough to force the meniscus back towards the head damper undesirably. Accordingly, the printer is capped and ink is at a position for printing and will not be displaced when the cap is removed due to uneven pressures.

Capping device 10 thereby maintains cavity 17 at an acceptable pressure by operating a suction pump and performing at least two open-close operations of valve 21. Achieving proper pressure in cavity 17 properly positions the meniscus of ink at the front end portion of nozzles 14 and facilitates disengaging cap 16 from print head 11. Primary opening and closing operation II can be repeated one or more times, after an interval $t_2$ that is shorter than rising suction time $t_1$ has elapsed.

Figure 4:
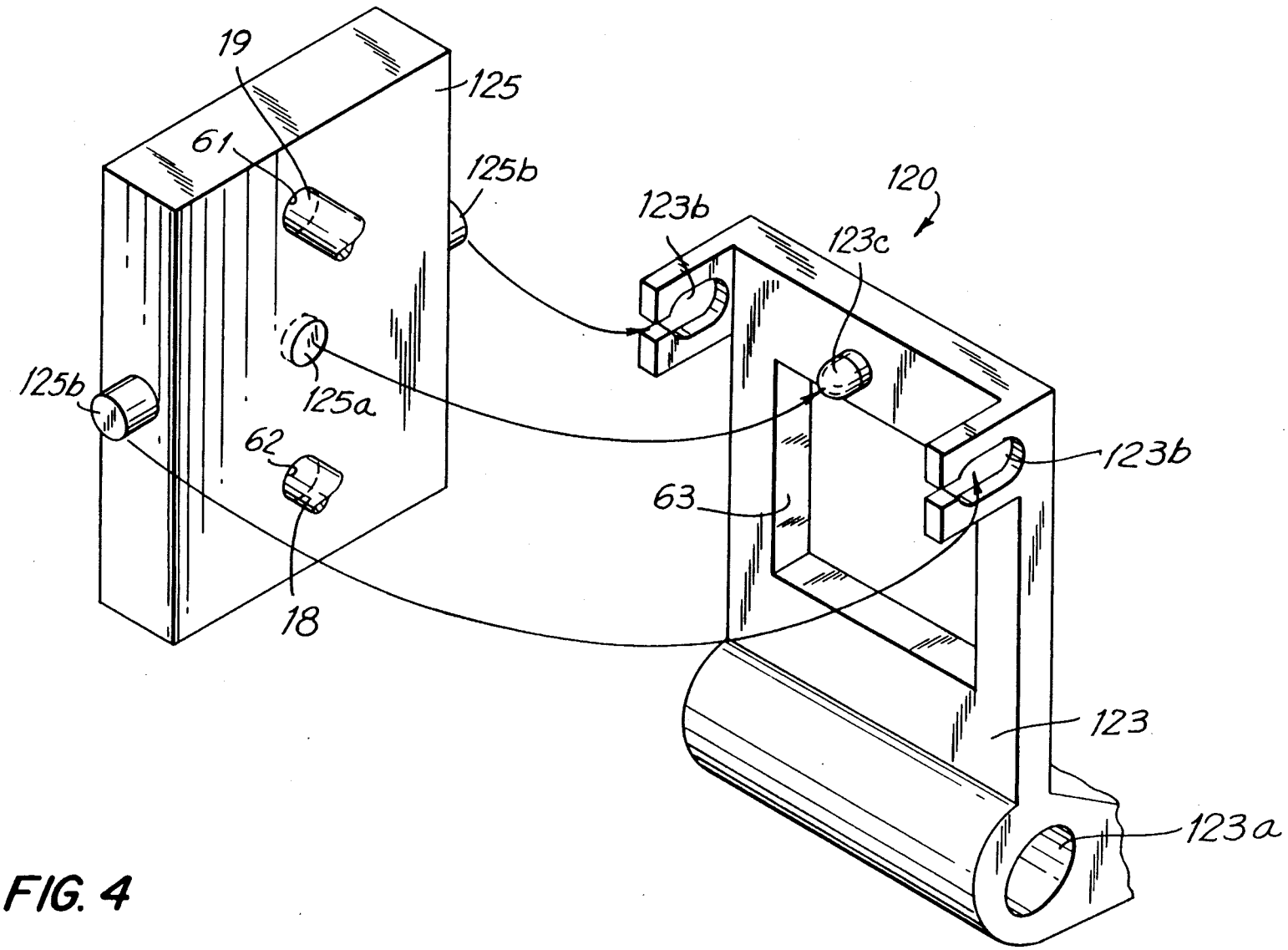
FIG. 4 is a perspective view of a cap support member for a capping device for an ink jet print head in accordance with the invention.

Referring now to FIG. 4, an example of a device for engaging and disengaging a sealing cap, such as cap 16, from a print head such as print head 11 in accordance with the invention, is shown as cap engaging device 120. Device 120 includes a cap support frame 125 for supporting a cap that can include a rubber-like sealing member for contacting a print head.

Cap support frame 125 includes a hemispherical recess 125*a* provided in a substantially central portion thereof and a pair of cylindrical projections 125*b* on both of the side edge surfaces thereof. Cap engaging device 120 also includes a cap support member 123 that is provided with a hemispherical projection 123*c* to cooperate with recess 125*a* and a pair of track bores 123*b* located at both sides of member 123 with projection 123*c* between. Track bores 123*b* are constructed and arranged for oscillatably and pivotally coupling to cylindrical projections 125*b* and hemispherical projection 123*c* is positioned to nest in hemispherical recess 125*a*. Hemispherical recess 125*a* is formed with a larger diameter than hemispherical projection 123*c* so that only one point of projection 123*c* will contact a surface of recess 125*a*.

Figure 5:
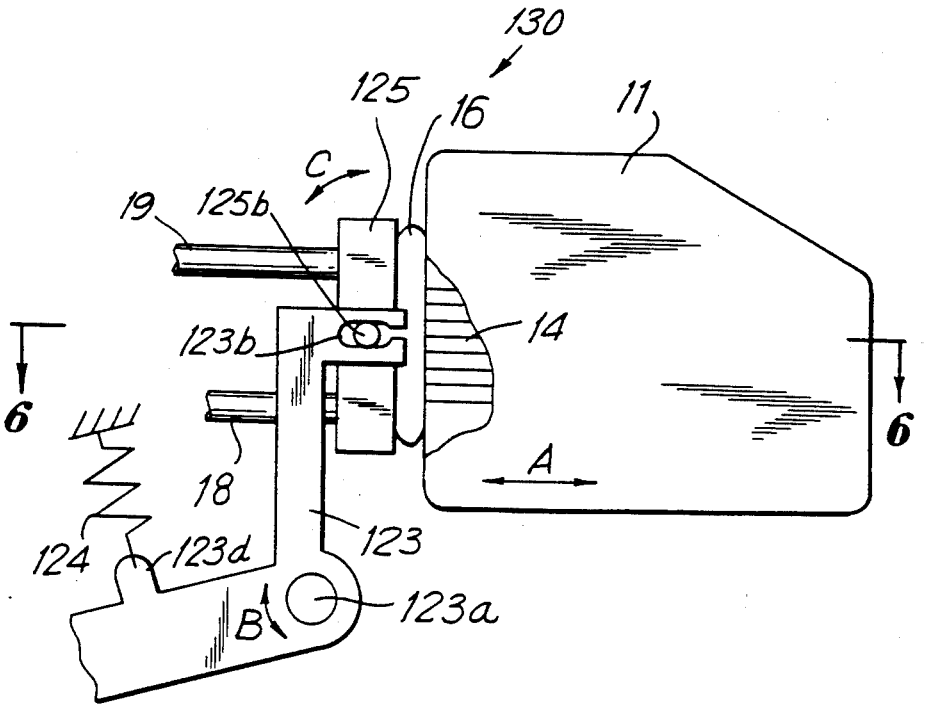
FIG. 5 is a side elevational view of an ink jet capping device for an ink jet printer in accordance with the invention.
Figure 6:
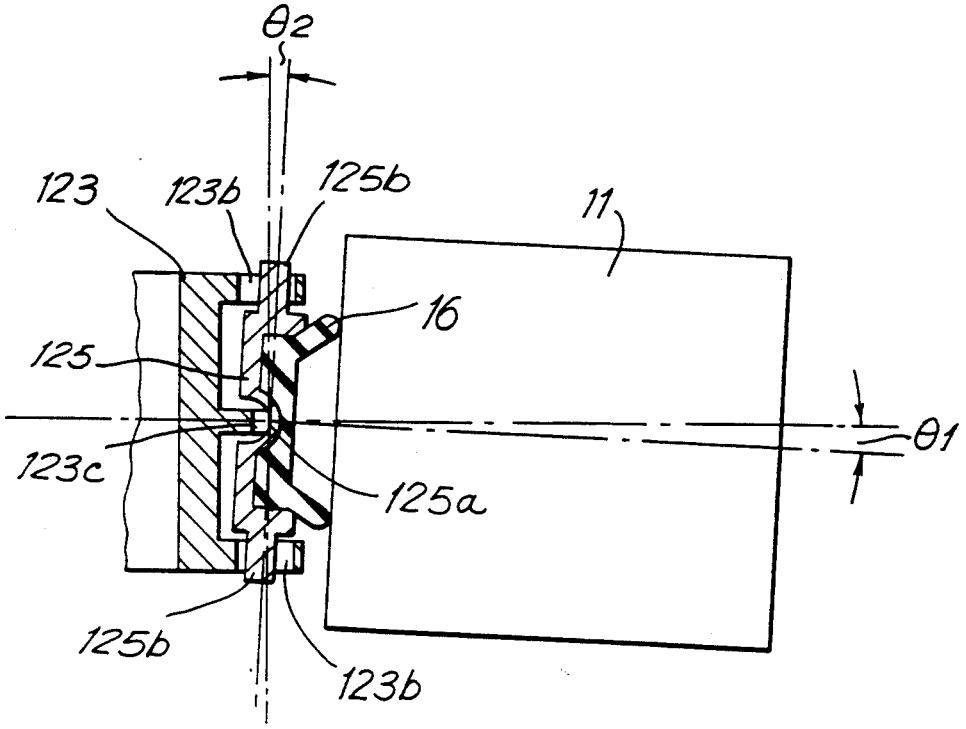
FIG. 6 is a cross-sectional view taken along line 6—6 of FIG. 5.

FIG. 5 is a side view of a capping device 130 including cap 16 of FIG. 1 coupled to cap support frame 125 of FIG. 4 and in contact with print head 11. Throughout the application, similar structures depicted in the figures are assigned the same reference numerals. FIG. 6 is a cross-sectional view of FIG. 5, taken along line 6—6.

Cap support member 123 includes a fulcrum 123*a* and a finger projection 123*d* coupled to a coiled tension spring 124 which pivots cap support member 123 to urge cap !6 towards print head 11. Cap support frame 125 also includes two through holes defined by a pair of cylindrical inner surfaces 61 and 62. Cap support member 123 includes a rectangular aperture defined by a rectangular inner surface 63. When cap support frame 125 is coupled to cap 16, tube 19 passes through the aperture defined by inner wall 61 and over cap support member 123. Tube 18 passes through the aperture defined by inner surface 62 and the rectangular aperture defined by inner surface 63.

Cap 16 should form a uniform and air tight seal with the front surface of print head 11. If print head 11 is displaced longitudinally with respect to cap 16 in the directions shown by double arrow A, cap support member 123 can pivot about fulcrum 123*a* in the directions shown by a double arrow B and projections 125*b* on cap support frame 125 can pivot and oscillate in track bores 123*b* in the directions shown by double arrow C. Accordingly, even if print head 11 displaced in the directions of double arrow A, cap 16 can remain effectively sealed over nozzles 14.

In addition to being able to compensate for longitudinal displacement, the configuration and arrangement of capping device 50 compensates for print head 11 being rotated through an angle $\theta_1$ with respect to cap support member 123. As print head 11 rotates through angle $\theta_1$, cap support frame 125 and cap 16 will rotate through an angle $\theta_2$, equal to the rotation of angle $\theta_1$. Hemispherical projection $123_c$ will pivot in hemispherical recess 125*a* and cylindrical projections 125*b* on cap support frame 125 will move in track bores 123*b* and cap 16 will remain securely sealed to print head 11.

As the above described displacements occur, hemispherical projection 123*c* will remain in contact with hemispherical recess 125 to transmit force supplied by spring 124 to keep cap 16 pressed against print head 11. To insure that the pressure distribution on the contacting portion of cap 16 remains uniform, hemispherical recess 125*a* in cap support frame 125 is preferably aligned with the center of the surface of cap 16 to be in contact with print head 11. The same effects can be obtained by switching the location of the recess and the projection and providing cap support member 123 with a hemispherical recess and providing cap support frame 125 with a hemispherical projection for engagement therewith.

Figure 7:
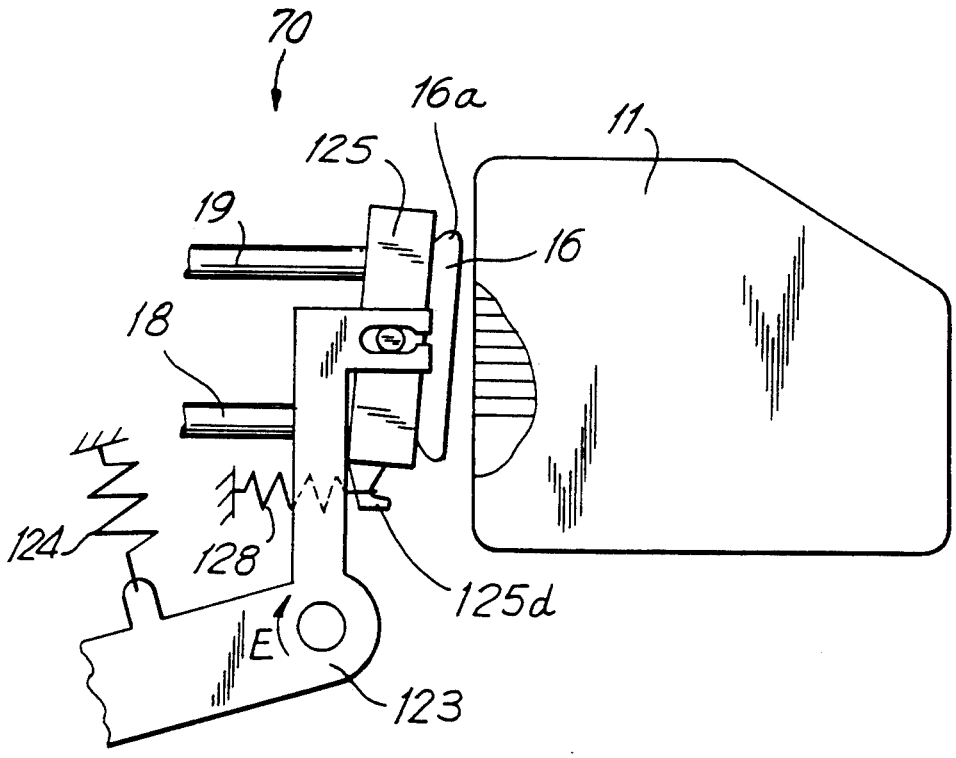
FIG. 7 is a side elevational view of a capping device for ink an jet printers in accordance with another embodiment of the invention.

FIG. 7 shows a side view of another capping device formed in accordance with the invention, similar in most respects to capping device 130 of FIGS. 5 and 6 and including a hook finger 125*d* extending from a lower surface of cap frame 125. A coiled tension spring 128 is coupled to hook finger 125*d* to urge the lower portion of cap 16 away from print head 11 and stabilize the position of cap 16 when not in contact with print head 11. As spring 124 urges cap 16 into contact print head 11, upper portion 16*a* of cap 16 will contact print head 11 before the bottom portion. When cap 16 is not in contact with print head 11, cap 16 is stabilized in a slightly inclined diagonal direction with respect to print head 11.

When print head 11 is capped by a cap closing mechanism (not shown) and the rotating force exerted by coiled tension spring 124, cap support member 123 pivots in the direction of an arrow E and upper portion 16*a* of the contacting surface of cap 16 comes into contact with print head 11. If the force of cap posture control spring 128 is too large, the surface pressure distribution of the contacting surface of cap 16 will become uneven. This leads to an imperfect seal. Therefore, it is desirable to set the force of cap posture control spring 128 to be as low as possible, but still control the posture of cap 16.

Figure 8:
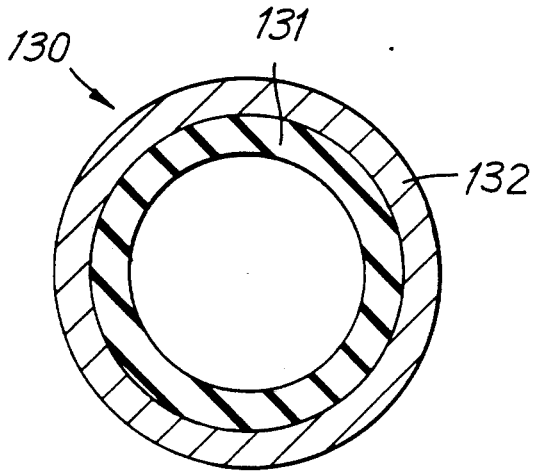
FIG. 8 is a cross-sectional view of a flexible tube connected to the cap in a capping device in accordance with the invention.

FIG. 8 is a cross-sectional view of a thin tube 130 well suited for use in an ink capping device formed in accordance with the invention. Tubes 18 and !9 preferably have the structure of tube 130. An inner wall portion 131 of flexible tube 130 is formed of a resin having high resistance to the effects of ink, such as polyethylene or polytetrafluoroethylene. An outer wall portion 132 of tube 130 is formed of a resin having high resistance to gas penetration, such as nylon or vinyl chloride. A tube of the form of tube 130 can be included as tubes 47, 48 and 49 of capping device shown 101 in FIG. 10 and will improve the performance of device 101 to make it acceptable for many applications.

Figure 9:
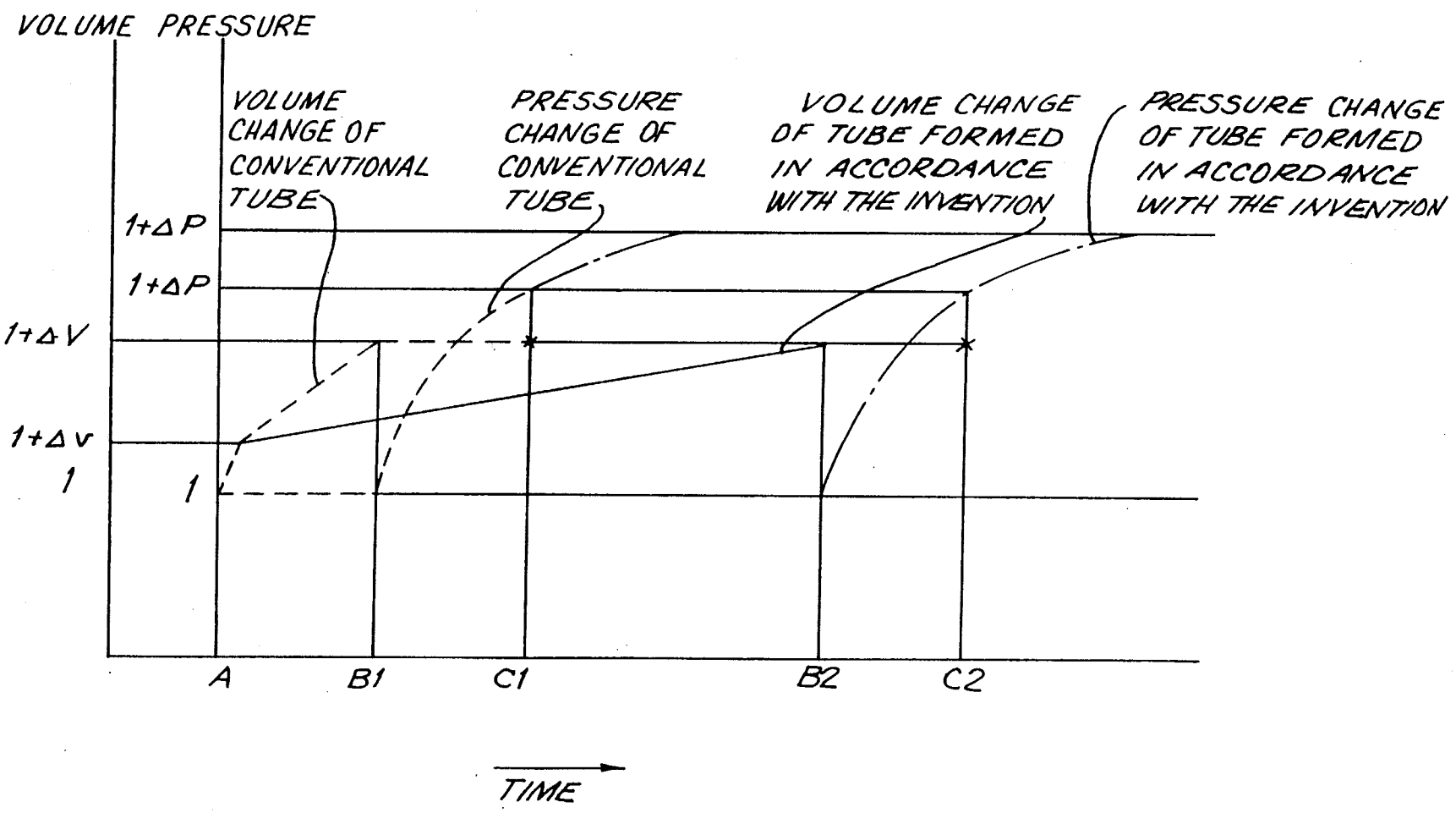
FIG. 9 is a graph showing changes of volume and pressure in the cap portions of a capping device utilizing a conventional tube and a tube formed in accordance with the invention.
Figure 10:
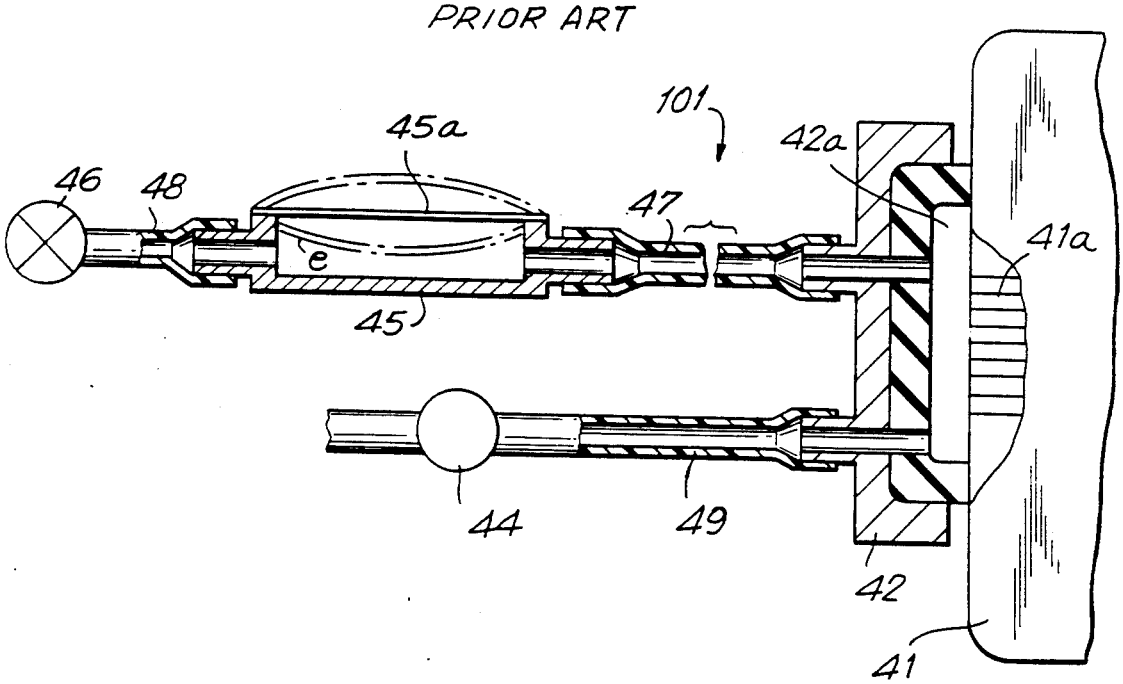
FIG. 10 PRIOR ART
FIG. 10 is a sectional view of a conventional print head capping device.
Figure 11:
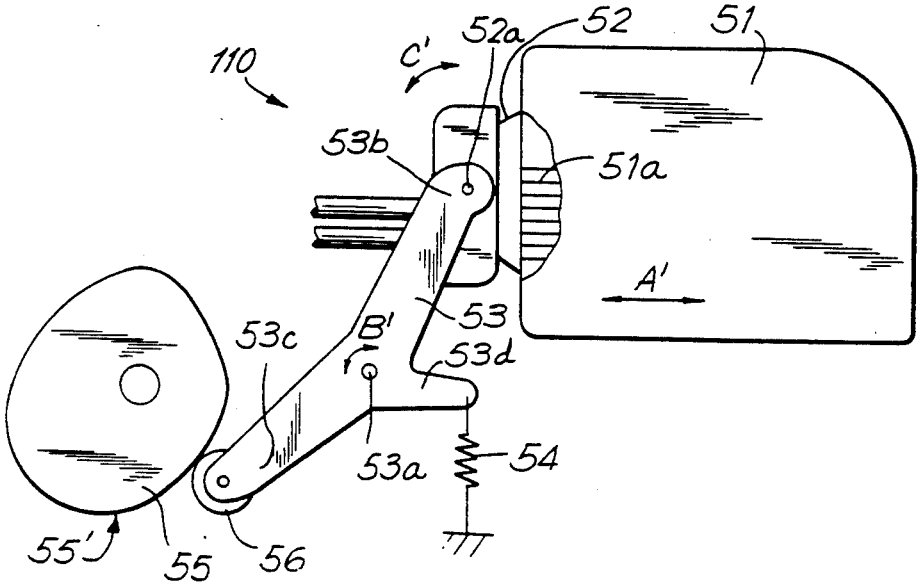
FIG. 11 PRIOR ART
FIG. 11 is a side elevational view of a cap turning mechanism in another conventional print head cap engagement device.

Referring to FIG. 10, print head 41 is capped with cap 42 after printing is completed. Valve 46 is open and suction pump 44 draws a small quantity of ink from ejection nozzle 41*a*. Expandable diaphragm 45*a* of expandable chamber 45 is bent inward as shown by broken line e. Suction pump 44 is stopped and valve 46 is closed to complete the capping operation. The change in volume of air and the pressure within capping device 101 is shown in the graph of FIG. 9. For convenience, it will be assumed that expandable chamber 45 expands by an amount $\Delta V$, which does not vary with pressure.

Referring to FIG. 9, as the printer is exposed to high temperatures, the volume of gas increases by an amount ▲V until time A is reached. At time A, the pressure in cap 42 remains about atmospheric and is denoted 1. However, the partial pressure of air will have decreased, corresponding to the increase in the partial pressure of water vapor resulting from the evaporation of water from the ink. Because the partial pressure of the outside air is essentially 1, air will flow through the conventional tubes and into cap 42 during the time interval from point A to point $B_1$. During the interval $A\text{-}B_1$ and $A\text{-}B_2$, the volume of gas will increase to 1 + ▲V. If the tube has high resistance to gas penetration, as represented by the solid line, the volume increase over time interval $A\text{-}B_1$ will be smaller and more gradual as shown by the solid line.

As shown in FIG. 9, if the tube has high resistance to gas penetration, such as tube 130, the rate of the volume increase is low and the volume of gas in the tube rises slowly as shown by the solid line from point A to point $B_2$. At this time the volume of the expandable chamber has increased to the limit ▲V. The conventional tube reaches a maximum volume at time $B_1$. At the point where the volume increase of either tube reaches a maximum, the internal pressure begins to increase and ultimately reaches 1 + ▲P (saturated vapor pressure). At this point, the internal pressure stabilizes.

At a temperature of 40° C., the saturated vapor pressure of water is 55.3 mmHg. A pressure difference of ▲p is equal to a pressure balance at the surface tension of the ink meniscus. This is the interface with respect to air in the cap and ink at the front end portion of the nozzle. If ▲P< ▲p, the force will be insufficient to displace the meniscus. When ▲P> ▲p, the ink meniscus at the front end portion of the nozzle begins to displace backwards before pressure within the cap has reached ▲P. This leads to imperfect ink ejection when printing is resumed.

However, if the tubes of the ink capping device are resistant to gas penetration, the time which expandable diaphragm chamber 45 requires to reach its expansion limit is greatly increased. This significantly postpones the occurrence of ▲P> ▲p backward displacement of the ink meniscus and provides a ink jet printer that is ready to print after longer non-printing periods.

Ink capping device 101 included a conventional 1.45 inch inner diameter polytetrafluoroethylene tube having a 2.2 inch outer diameter. When the device was exposed to ambient temperature of 40° C., the meniscus of ink at the front end portion of the ink jet nozzle displaced away from the front surface of print head 41 after about 3 days. In contrast, a two layer tube similar to tube 130 was prepared having a 1.45 inch polyethylene inner tube member, a 2.2 inch outer diameter and a 0.2 mm thick nylon outer tube member. When this tube was installed in device 101, the ink meniscus did not displace after over one month. Thus, it was concluded that the tube formed in accordance with the invention prevented backward displacement of the ink meniscus for a sufficient period of time for most practical purposes.

Another example of a tube formed in accordance with the invention was formed by coating a flexible tube formed of material highly resistant to ink with a resin having high gas penetration resistance. For example, a flexible polyethylene tube was coated with a polyvinylidine chloride saran resin. Backward displacement of the ink meniscus was postponed for a acceptable period and the same beneficial effects described above were obtained.

Still another tube formed in accordance with the invention was fabricated by condensing a metal on the outer surface of a flexible tube formed of a material highly resistant to ink. For example, an inner tube was coated with aluminum and the above beneficial effects described above were obtained.

In accordance with the invention, a sealing member such as a cap having a sealing member formed of an elastic material is provided to form an air tight seal around an ink orifice portion of a print head. The printer can be a printer that forms characters and images by jetting drops of ink from nozzles in the print head onto a recording medium. The nozzles can be the only orifice exposing ink of the printer to the atmosphere. A suction mechanism is provided for evacuating the interior of the sealing member and a valve is also provided to stabilize pressure within the sealing member. A preliminary opening and closing operation of the valve is carried out subsequent to a period of rising suction and then a primary opening and closing operation occurs, but for a shorter period of time.

Accordingly, even if the pressure in the interior of a print head ink reservoir becomes low enough to siphon the meniscus of ink in the print head backwards to an unacceptable level after a suction device draws ink from the head reservoir to the front printing portion of the print head, the vacuum in the head reservoir can be regulated to prevent destruction of the ink meniscus by carrying out the primary opening and closing operations for short periods of time after the preliminary opening and closing operations are completed.

When the interior of the sealing member returns to an acceptable pressure, ink can be drawn back to the front end of the nozzle. This prevents imperfect printing and increases the reliability of the print head and facilitates disengagement of the sealing member from the print head.

A cap member in accordance with the invention can be supported on a support frame and a support member so that it can be pivoted in at least two directions. The support frame and support member provide a reliable capping device for an ink jet printer including a mechanism capable of bringing a contacting sealing surface of the cap into close and parallel contact with the print head and continue to provide a uniform seal when the positional relationship between the print head and the cap member varies. This prevents uneven surface pressure along the sealing surface of the cap which leads to improve prevention of ink desiccation and leakage. In one embodiment, the capping device includes a posture control spring to maintain the cap in a constant posture with respect to the print head during non-capped periods.

Flexible tubes formed in accordance with the invention have at least a double structure that includes an inner tube member which can be formed of a resin having high ink resistance and an outer tube member formed of a substance having high gas penetration resistance. Accordingly, even when the printer is exposed to high temperatures for extended intervals, an increase in the volume or gas within the sealed portion is acceptably suppressed and the backward displacement of the ink meniscus is postponed for an acceptably long period of time. This is advantageous so that restarting the printer after it is capped is simplified and printing can be resumed with minimal down time.

It will thus be seen that the objects set forth above, among those made apparent from the preceding description, are efficiently attained and, since certain changes may be made in carrying out the above method and in the constructions set forth without departing from the spirit and scope of the invention it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A capping device for sealing an ink jet print head having an ink nozzle exposed to the atmosphere at the front surface thereof, comprising:

a cap having a deformable surface for providing an air tight seal around the nozzle by contacting the deformable surface of the cap with the front surface of the print head with a cap cavity formed between the cap and the print head;

valve means having an open and a closed position operatively coupled to the cap cavity for regulating the pressure within the cap cavity;

suction means operatively coupled to the cap cavity for lowering the pressure within the cap cavity when the valve means is closed; and valve regulation means operatively coupled to the valve means for regulating the pressure within the cap cavity by opening and closing the valve means, the valve regulation means adapted to close the valve means for a period of time $t_1$ that is rising suction time, then open the valve means and then close the valve means again for a period of rising suction time $t_2$ that is shorter than $t_1$ to develop less vacuum in the cap cavity during $t_2$ than is developed during $t_1$ at least once after elapse of time $t_1$ to return the nozzle too atmospheric pressure and maintain the vacuous pressure within the print head rearward of the nozzle at a sufficiently low level too maintain a meniscus of ink at the outlet portion of the nozzle.

2. The capping device of claim 1, wherein the valve means includes a valve having a valve spring and a solenoid, the spring maintaining the valve in a closed position when the solenoid is not energized, and the solenoid placing the valve in an open condition when the solenoid is energized.

3. A capping device for sealing an ink jet printer having an ink nozzle exposed to the atmosphere at the front surface thereof, comprising:

a cap including a deformable material for forming an air-tight seal about the nozzle; and coupling means for supporting the cap and displacing the cap from a print position away from the print head and a non-print position for sealing the print head, the coupling means adapted to permit the cap to pivot in at least two directions with respect to the center of the cap to press the contact surface of the cap against the print head with substantially uniform pressure around the deformable material pressed against the front surface of the printer;

the coupling means including a first member having a hemispheric projection and a second cooperating member, the cap mounted to the second member which has a hemispheric recess with a larger diameter than the hemisphere projection, the projection nested in the hemispheric recess for applying force for substantially uniformly pressing the cap against the print head.

4. The capping device of claim 3, including cap posture control means for maintaining the cap in a selected position with respect to the cap support means when the cap is in a print position not in contact with the print head.

5. The capping device of claim 4, wherein the cap posture control means is a spring coupled to the second member for biasing a portion of the deformable surface of the cap away from the print head.

6. The capping device of claim 3, wherein the coupling means includes cylindrical projections on one member and cooperating track bores on the other member for engaging the cylindrical projections of pivotally and oscillatably securing the two cooperating members together.

7. A capping device for an ink jet printer including a print head having a nozzle for ejecting ink, comprising:

a cap adapted to seal the nozzle during non-printing time;

suction means coupled to the cap and adapted to suck ink through said nozzle;

valve means coupled to the cap for regulating pressure at the nozzle; and a flexible tube for operatively connecting the suction means and valve means to the cap, the tubes having an inner tube portion formed of material that is highly resistant to the corrosive effects of ink and an outer tube portion that is highly resistant to gas penetration.

8. The capping device of claim 7, wherein the tube is formed of two layers, including an inner tube formed of material highly resistant to ink and an outer tube of a material having high gas penetration resistance.

9. The capping device of claim 8, wherein the tubes are formed by coating the exterior surface of the ink resistant tube with a material having high gas penetration resistance.

10. The capping device of claim 8, wherein the tubes are formed by coating the exterior surface of the ink resistant inner tube with a metal.

11. The capping device of claim 8, wherein the inner tube is formed of one of polyethylene or polytetrafluoroethylene and the outer tube portion is formed from one of nylon or vinyl chloride.

12. The capping device of claim 8, wherein the outer tube portion includes a polyvinylidine chloride saran resin.

13. A method of capping a print head in an ink jet printer having a damper in fluid communication with an ink nozzle exposed to the atmosphere, comprising:

sealing the ink nozzle;

applying suction to the outer side of the nozzle for a first period of time t to establish a first low pressure level at the nozzle and a first low pressure in the damper;

exposing the nozzle to atmospheric pressure for a second time interval tz to place the damper at substantially atmospheric pressure;

resealing the nozzle and continuing to apply suction for a third time interval $t_3$ than the first time interval $t_1$, to reduce the pressure at the nozzle to a level higher than the first pressure level and the pressure in damper higher than the first damper pressure level and of high enough pressure to prevent the meniscus at the nozzle from being siphoned back to the damper below the first ink level; and returning the nozzle to atmospheric pressure after the third time interval $t_3$ and resealing the nozzle and ceasing to apply suction to the nozzle.

14. The method of claim 13, wherein the nozzle is sealed with a cap having a deformable surface for forming a cavity about the nozzle and at least one tube disposed through the cap and in fluid communication with the cavity and operatively coupled to a valve for sealing the cavity when the valve is closed and opening the cavity to the atmosphere when the valve is opened and operatively coupled to a suction pump for applying suction to the cavity when the pump is operated.

15. The method of claim 14, wherein the tube is formed of an inner material that is highly resistant to ink and an outer material that is highly resistant to gas penetration.

16. A capping device for a print head of an ink jet printer having an ink nozzle exposed to the atmosphere at a front surface thereof, comprising:

cap means for contacting the front surface of the print head and surrounding and sealing the ink nozzle, the cap means and the front surface of the print head defining a cavity when the cap means is in operative contact with the print head;

at least one tube operatively coupled to the cap means and in fluid communication with the cavity;

expandable chamber means including flexible diaphragm means for absorbing minor gas volume changes within the cavity so that the gas pressure within the cavity does not vary substantially with minor changes in gas volume therein, in fluid communication with the cavity;

suction means for lowering the pressure within the cavity, operatively coupled to the cap means;

valve means operatively coupled to the expandable chamber means by a first tube for selectively regulating pressure within the cavity, in fluid communication with the cavity;

the expandable chamber operatively coupled to the cavity by a second tube and a suction means is operatively coupled to the cavity by a third tube; and the tubes include a first inner portion highly resistant to the corrosive effects of ink and an outer portion disposed around the inner portion highly resistant to gas penetration.

17. The capping device of claim 16, wherein the inner portion is formed of one of polyethylene or polytetrafluoroethylene and the outer portion is formed from one of nylon or vinyl chloride.

18. The capping device of claim 16, wherein the outer portion includes a polyvinylidine chloride saran resin.

19. The capping device of claim 16, wherein the outer portion is formed of metal.

* * * * *

UNITED STATES PATENT AND TRADEMARK OFFICE

CERTIFICATE OF CORRECTION

PATENT NO. : 5,055,856

DATED : September 6, 1989

INVENTOR(S) : Tsuyoshi Tomii et al.

It is certified that error appears in the above-identified patent and that said Letters Patent is hereby corrected as shown below:

Column 12:

In claim 13, line 6, change "t" to --$t_1$--; and
line 10, change "tz" to --$t_2$--.

Signed and Sealed this

Twelfth Day of January, 1993

*Attest:*

DOUGLAS B. COMER

*Attesting Officer*

*Acting Commissioner of Patents and Trademarks*